US009383128B2

(12) United States Patent
Boarman et al.

(10) Patent No.: US 9,383,128 B2
(45) Date of Patent: Jul. 5, 2016

(54) REFRIGERATOR WITH ICE MOLD CHILLED BY AIR EXCHANGE COOLED BY FLUID FROM FREEZER

(71) Applicant: Whirlpool Corporation, Benton Harbor, MI (US)

(72) Inventors: Patrick J. Boarman, Evansville, IN (US); Gregory Gene Hortin, Henderson, KY (US)

(73) Assignee: Whirlpool Corporation, Benton Harbor, MI (US)

( * ) Notice: Subject to any disclaimer, the term of this patent is extended or adjusted under 35 U.S.C. 154(b) by 289 days.

(21) Appl. No.: 13/691,883

(22) Filed: Dec. 3, 2012

(65) Prior Publication Data

US 2014/0150486 A1 Jun. 5, 2014

(51) Int. Cl.

| | |
|---|---|
| ***F25B 21/02*** | (2006.01) |
| ***F25C 1/04*** | (2006.01) |
| ***F25C 5/00*** | (2006.01) |
| ***F25D 11/02*** | (2006.01) |
| ***F25D 17/06*** | (2006.01) |
| ***F25C 5/18*** | (2006.01) |

(52) U.S. Cl.

CPC . *F25C 1/04* (2013.01); *F25B 21/02* (2013.01); *F25C 5/005* (2013.01); *F25C 5/182* (2013.01); *F25D 11/02* (2013.01); *F25D 17/065* (2013.01); *F25B 2321/0251* (2013.01); *F25D 2317/061* (2013.01)

(58) Field of Classification Search

CPC ..... F25D 17/065; F25B 21/02; F25B 2321/02
USPC ..... 62/3.63
See application file for complete search history.

(56) References Cited

U.S. PATENT DOCUMENTS

| | | | |
|---|---|---|---|
| 4,193,271 | A | 3/1980 | Honigsbaum |
| 4,251,996 | A | 2/1981 | Esformes |
| 5,237,832 | A | 8/1993 | Alston |
| 5,497,629 | A | 3/1996 | Rafalovich |

(Continued)

FOREIGN PATENT DOCUMENTS

| | | | |
|---|---|---|---|
| DE | 102010001465 | A1 | 8/2011 |
| DE | 102010042080 | A1 | 4/2012 |

(Continued)

OTHER PUBLICATIONS

EP Search Opinion, EP2738483, Dated Feb. 2. 2015.

(Continued)

*Primary Examiner* — Cassey D Bauer

(57) ABSTRACT

A refrigerator that has a fresh food compartment, a freezer compartment, and a door that provides access to the fresh food compartment is disclosed. An icemaker is mounted remotely from the freezer compartment. The icemaker includes an ice mold. A thermoelectric device is provided and includes a warm side and an opposite cold side. A flow pathway is connected in communication between the cold side of the thermoelectric device and the icemaker. A fan is operatively positioned to move air from the fresh food compartment across the warm side of the thermoelectric device. A pump moves fluid from the cold side of the thermoelectric device to the icemaker. Cold air, such as from the refrigerator compartment, is used to dissipate heat from the warm side of the thermoelectric device for providing cold fluid to and for cooling the ice mold of the icemaker.

19 Claims, 9 Drawing Sheets

(56) References Cited

U.S. PATENT DOCUMENTS

| | | | | |
|---|---|---|---|---|
| 5,505,046 | A | 4/1996 | Nelson | |
| 5,598,716 | A | 2/1997 | Tanaka | |
| 6,112,543 | A | 9/2000 | Feuerecker | |
| 6,327,871 | B1 | 12/2001 | Rafalovich | |
| 6,408,633 | B1 | 6/2002 | Carr | |
| 6,735,959 | B1 | 5/2004 | Najewicz | |
| 7,089,756 | B2 | 8/2006 | Hu | |
| 7,093,458 | B2 | 8/2006 | Hu | |
| 7,269,960 | B2 | 9/2007 | Elsom | |
| 7,278,269 | B2 | 10/2007 | Pham | |
| 7,284,379 | B2 | 10/2007 | Pham | |
| 7,310,953 | B2 | 12/2007 | Pham | |
| 7,610,773 | B2 | 11/2009 | Rafalovich | |
| 7,752,852 | B2 | 7/2010 | Akei | |
| 7,942,018 | B2 | 5/2011 | Niu | |
| 8,042,355 | B2 | 10/2011 | Cur | |
| 8,061,153 | B2 | 11/2011 | Cur | |
| 8,099,975 | B2 | 1/2012 | Rafalovich | |
| 2005/0210909 | A1* | 9/2005 | Kim et al. | 62/340 |
| 2005/0252232 | A1* | 11/2005 | Lee et al. | 62/340 |
| 2006/0168983 | A1 | 8/2006 | Tatsui | |
| 2006/0260325 | A1 | 11/2006 | Lin | |
| 2006/0260350 | A1 | 11/2006 | Van Meter | |
| 2007/0051127 | A1 | 3/2007 | McMillin | |
| 2008/0156007 | A1 | 7/2008 | Cur | |
| 2008/0156009 | A1 | 7/2008 | Cur | |
| 2008/0156028 | A1 | 7/2008 | Cur | |
| 2008/0156030 | A1 | 7/2008 | Cur | |
| 2008/0156031 | A1 | 7/2008 | Cur | |
| 2008/0156032 | A1 | 7/2008 | Cur | |
| 2008/0156033 | A1 | 7/2008 | Cur | |
| 2008/0156034 | A1 | 7/2008 | Cur | |
| 2009/0151375 | A1 | 6/2009 | Tarr | |
| 2009/0158767 | A1 | 6/2009 | McMillin | |
| 2009/0158768 | A1 | 6/2009 | Rafalovich | |
| 2009/0165491 | A1 | 7/2009 | Rafalovich | |
| 2009/0260371 | A1 | 10/2009 | Kuehl | |
| 2009/0282844 | A1 | 11/2009 | Rafalovich | |
| 2009/0293501 | A1* | 12/2009 | Kulkarni | F25C 5/005 62/3.63 |
| 2010/0115985 | A1* | 5/2010 | Mitchell et al. | 62/441 |
| 2010/0126185 | A1 | 5/2010 | Cho | |
| 2010/0138073 | A1 | 6/2010 | Tarr | |
| 2010/0147005 | A1 | 6/2010 | Watson | |
| 2010/0147007 | A1 | 6/2010 | Froelicher | |
| 2010/0147008 | A1 | 6/2010 | Watson | |
| 2010/0154458 | A1 | 6/2010 | Davis | |
| 2010/0242526 | A1 | 9/2010 | Junge | |
| 2010/0326093 | A1 | 12/2010 | Watson | |
| 2010/0326112 | A1 | 12/2010 | Prabhakar | |
| 2011/0011119 | A1 | 1/2011 | Kuehl | |
| 2011/0113810 | A1 | 5/2011 | Mitchell | |
| 2011/0162829 | A1 | 7/2011 | Xiang | |
| 2012/0031129 | A9 | 2/2012 | Tarr | |
| 2012/0167596 | A1 | 7/2012 | Krause | |

FOREIGN PATENT DOCUMENTS

| | | | |
|---|---|---|---|
| EP | 1821051 | A1 | 8/2007 |
| EP | 2444761 | A2 | 4/2012 |

OTHER PUBLICATIONS

EP Search Opinion, EP2738484, Dated Feb. 23, 2015.
EP Search Opinion, EP2738485, Dated Feb. 2, 2015.
EP Search Opinion, EP2738496, Dated Feb. 2, 2015.
EP Search Opinion, EP2738497, Dated Feb. 2, 2015.
DE102010042080 Machine Translation from Espacenet.
DE102010001465 Machine Translation from Espacenet.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.

* cited by examiner

REFRIGERATOR WITH ICE MOLD CHILLED BY AIR EXCHANGE COOLED BY FLUID FROM FREEZER

FIELD OF THE INVENTION

The invention relates generally to refrigerators with icemakers, and more particularly to refrigerators with the icemaker located remotely from the freezer compartment.

BACKGROUND OF THE INVENTION

Household refrigerators commonly include an icemaker to automatically make ice. The icemaker includes an ice mold for forming ice cubes from a supply of water. Heat is removed from the liquid water within the mold to form ice cubes. After the cubes are formed they are harvested from the ice mold. The harvested cubes are typically retained within a bin or other storage container. The storage bin may be operatively associated with an ice dispenser that allows a user to dispense ice from the refrigerator through a fresh food compartment door.

To remove heat from the water, it is common to cool the ice mold. Accordingly, the ice mold acts as a conduit for removing heat from the water in the ice mold. When the icemaker is located in the freezer compartment this is relatively simple, as the air surrounding the ice mold is sufficiently cold to remove heat and make ice. However, when the icemaker is located remotely from the freezer compartment, the removal of heat from the ice mold is more difficult.

Therefore, the proceeding disclosure provides improvements over existing designs.

SUMMARY OF THE INVENTION

According to one aspect, a refrigerator that has a fresh food compartment, a freezer compartment, and a door that provides access to the fresh food compartment is disclosed. An icemaker is mounted remotely from the freezer compartment. The icemaker includes an ice mold. An air supply pathway is connected in communication between the icemaker and the fresh food compartment. A fan is positioned to move air from the fresh food compartment through the air supply pathway. A heat exchanger is positioned in the fresh food compartment in communication with the air supply pathway and, a flow pathway is connected in communication between the heat exchanger and the freezer compartment.

According to another aspect, a method for cooling an icemaker in a refrigerator is disclosed. The refrigerator has a fresh food compartment, a freezer compartment and a door that provides access to the fresh food compartment. An icemaker is mounted remotely from the freezer compartment. The icemaker includes an ice mold. An air supply pathway is in communication between the icemaker and the fresh food compartment. Air is moved from the fresh food compartment to the air supply pathway. A heat exchanger is positioned in the fresh food compartment and in communication between the heat exchanger and the freezer compartment for providing a sub-zero exchange of liquid from the freezer compartment to air in the refrigerator compartment for chilling the ice mold.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1:
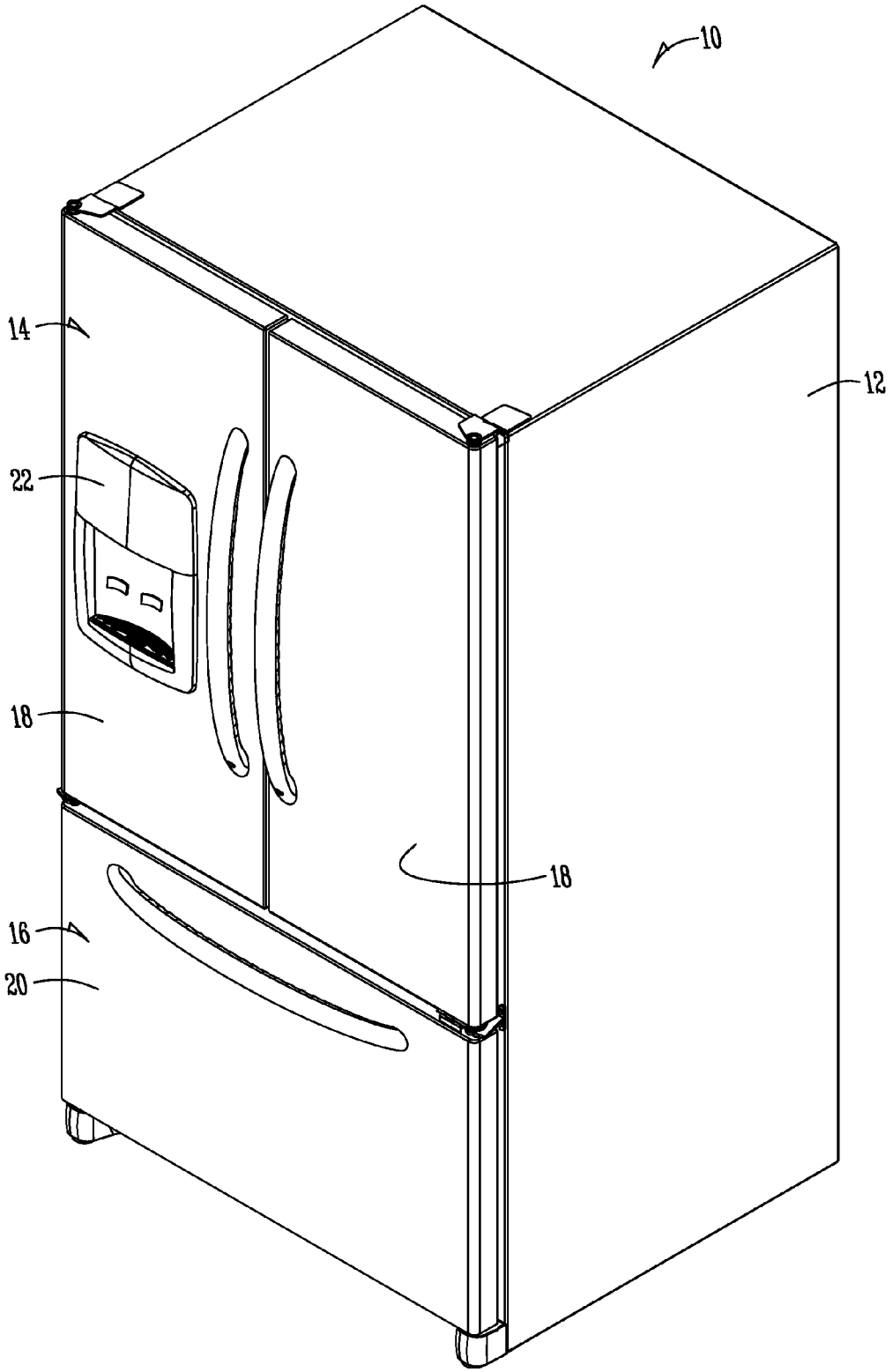
FIG. 1 is a perspective view illustrating exemplary aspects of a refrigerator.

Referring to the figures, there is generally disclosed in FIGS. 1-8 a refrigerator 10 configured to dispense ice from an icemaker 102 chilled by air taken from the fresh food compartment or refrigerator compartment 14 chilled by a sub-zero freezer exchange from the freezer compartment 16. The refrigerator 10 includes a cabinet body 12 with a refrigerator compartment or fresh food compartment 14 selectively closeable by a refrigerator compartment door 18 and a freezer compartment 16 selectably closeable by a freezer compartment door 20. A dispenser 22 is included on a refrigerator compartment door 18 for providing dispensions of liquid and/or ice at the refrigerator compartment door 18. Although one particular design of a refrigerator 10 is shown in FIG. 1 and replicated throughout various figures of the disclosure, other styles and configurations for a refrigerator are contemplated. For example, the refrigerator 10 could be a side-by-side refrigerator, a traditional style refrigerator with the freezer compartment positioned above the refrigerator compartment (top-mount refrigerator), a refrigerator that includes only a refrigerator or fresh food compartment and no freezer compartment, etc. In the figures is shown a bottom-mount refrigerator 10 where the freezer compartment 16 is located below the refrigerator compartment 14.

A common mechanism for removing heat from an icemaker 102, and thereby the water within the ice mold 106, is to provide cold air from the freezer compartment or freezer evaporator to the ice mold 106 by a ductwork or similar structure. However, such ductwork and fans can complicate construction of the refrigerator, especially when the icemaker 102 is on a door.

A refrigerator 10, such as illustrated in FIG. 1 may include a freezer compartment 16 for storing frozen foods, typically at temperatures near or below 0° Fahrenheit, and a fresh food section or refrigerated compartment 14 for storing fresh foods at temperatures generally between 38° Fahrenheit and about 42° Fahrenheit. It is common to include icemakers and ice dispensers in household refrigerators. In a side-by-side refrigerator, where the freezer compartment and the fresh food compartment are located side-by-side and divided by a vertical wall or mullion, the icemaker and ice storage bin are generally provided in the freezer compartment and the ice is dispensed through the freezer door. In recent years it has become popular to provide so-called bottom mount refrigerators wherein the freezer compartment is located below the fresh food compartment, at the bottom of the refrigerator. It is advantageous to provide ice dispensing through the refrigerated compartment door 18 so that the dispenser 22 is at a convenient height. In bottom mount refrigerators the icemaker and ice storage may be provided within a separate insulated compartment 108 located generally within or adjacent to, but insulated from, the fresh food compartment.

An additional challenge for refrigerators where the icemaker 102 is located remotely from the freezer compartment is the storage of ice after it is harvested. One way for retaining the ice in such situations is to provide an insulated compartment or bin 108 and to route the cold air used to chill the ice mold 106 to cool the ice.

Several aspects of the disclosure addressing the aforementioned challenges are illustrated in the sectional and cutout views of refrigerator 10.

In connection with the dispenser 22 in the cabinet body 12 of the refrigerator 10, such as for example on the refrigerator compartment door 18, is an icemaker 102 having an ice mold 106 for extracting heat from liquid within the ice mold to create ice which is dispensed from the ice mold 106 into an ice storage bin 104. The ice is stored in the ice storage bin 104 until dispensed from the dispenser 22. The ice mold 106 or icemaker 102 may include an air sink 132 for extracting heat from the ice mold 106 using air as the extraction medium. Air for chilling the ice mold 106 may also be transferred from the freezer compartment 16 directly to the icemaker 102 or through the refrigerator compartment 14 to the icemaker 102 on the refrigerator compartment door 18.

In another aspect, liquid may be used as the medium for carrying away heat form the ice mold 106. A fluid sink (not shown, but in an exemplary configuration the fluid sink would take the place of the air sink 56 and be positioned in thermal contact with the ice mold 106) may be used to remove heat from the ice mold 106. A fluid supply pathway (not shown) may be connected between the refrigerator compartment door 18 and the heat exchanger 50 in the refrigerator compartment 14 for communicating chilled fluid from the heat exchanger 50 to the icemaker 102 on the refrigerator compartment door 18. In another embodiment, chilled fluid (e.g., glycol or ethylene propylene) could be transferred from the freezer compartment 16 directly to the icemaker 102 or through the refrigerator compartment 14 to the icemaker 102 on the refrigerator compartment door 18.

Figure 2:
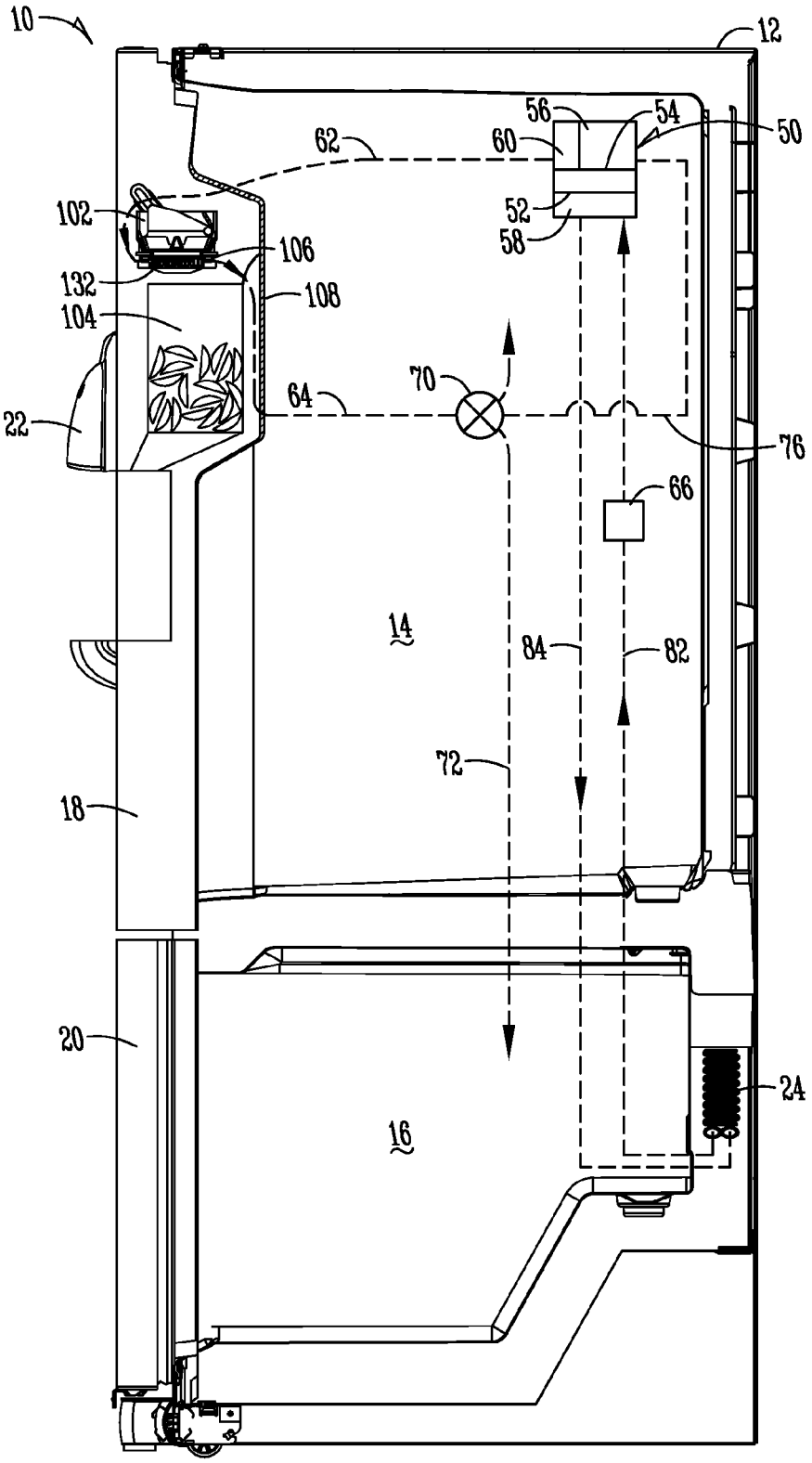
FIG. 2 is a side elevation view showing a sectional of the refrigerator illustrated in FIG. 1.

In FIG. 2 an elevation view showing a cross-section of a refrigerator 10 is provided. The refrigerator 10 includes an icemaker 102 that may be included or positioned on the refrigerator compartment door 18. The icemaker 102 may be housed in an insulated compartment 108. Insulated compartment 108 provides a thermal barrier between the icemaker 102, the ice storage bin 104 and the refrigerator compartment 14. The icemaker 102 includes an ice mold 106 and an air sink 132 in thermal contact with the ice mold 106 for producing ice which is harvested and dispensed into the ice storage bin 104. To remove heat from the water, it is common to cool the ice mold 106 specifically. Accordingly, the ice mold 106 acts as a conduit for removing heat from the water in the ice mold. As an alternative to bringing freezer air to the icemaker, a thermoelectric (TEC) device may be used to chill the ice mold 106. The TEC device uses the Peltier effect to create a heat flux when an electric current is supplied at the junction of two different types of materials. The electrical current creates a component with a warm side and cold side. The TEC device is commercially available in a variety of shapes, sizes, and capacities. TEC devices are generally compact, relatively inexpensive, can be carefully calibrated, and can be reversed in polarity to act as heaters to melt the ice at the mold interface to facilitate ice harvesting. Generally, TEC devices can be categorized by the temperature difference (or delta) between its warm side and cold side. In the ice making context this means that the warm side must be kept at a low enough temperature to permit the cold side to remove enough heat from the ice mold 106 to make ice at a desired rate. Therefore, the heat from the warm side of a TEC device must be removed to maintain the cold side of the mold sufficiently cold to make ice. Removing enough heat to maintain the warm side of the TEC device at a sufficiently cold temperature creates a challenge. In the case where the heat exchanger 50 is a TEC device, the TEC device may be positioned at the icemaker 102 with its cold side 54 in thermal contact with the ice mold 106. Alternatively, a TEC device may be positioned within the refrigerator compartment 14 with its cold side 54 in thermal contact with an air sink 56 or a fluid sink (not shown) for communicating chilled air or fluid from the refrigerator compartment 14 to the refrigerator compartment door 18. Thus, a TEC device may be positioned in the refrigerator compartment 14 or on the refrigerator compartment door 18. There are advantages depending upon where in the refrigerator the TEC device is positioned. In the case where the TEC device is positioned in the refrigerator compartment 14 a fluid loop or fluid supply pathway can be configured to carry chilled fluid (e.g., ethylene glycol) from the TEC device to the icemaker 102 on the refrigerator compartment door 18. For example, fluid is a more efficient carrier of heat (i.e., able to carry more heat per volume) than air so smaller tubing or hose (compared to an airduct), smaller and quitter pumps, and smaller volumetric flows are required to move the same amount of heat by air. Generally, the fluid carrying member (e.g., tube) is less likely to sweat or cause condensation to form. Fluid also has a higher thermal conductivity and is able to harvest heat from a fluid sink made from, for example, aluminum or zinc diecast faster than air even for smaller volumetric flows. Fluid pumps are also generally more efficient and quiet than air pumps that cost generally the same amount. Using a fluid like glycol or ethylene propylene also increases the above-described efficiencies, over for example, using air as the heat carrier. Another advantage of positioning the TEC device in the refrigerator compartment 14 is the ability to use a TEC device with a larger footprint (compared to those that are used at the icemaker 102 or on the refrigerator compartment door 18). A TEC device with a larger footprint generally has a greater heat transfer capacity (e.g., larger delta, heat transfer and volume rates). The TEC device may have more capacity than is needed to chill the icemold 106. The extra capacity can be used to chill water dispensed into the icemold 106 to make ice, heat/chill fluid for warming or cooling another zone within the refrigerator or on one or more of the doors (e.g., warm/cool a bin, drawer or shelf). If the TEC device is adequately large and efficient, the refrigerator may be configured without a compressor. In such a design, the refrigerator could be configured with one or more TEC devices for providing chilled fluid or air to specific zones within the refrigerator (e.g., chilled air or fluid transferred to any number of specific bins, compartments, locations, or shelves).

Figure 3:
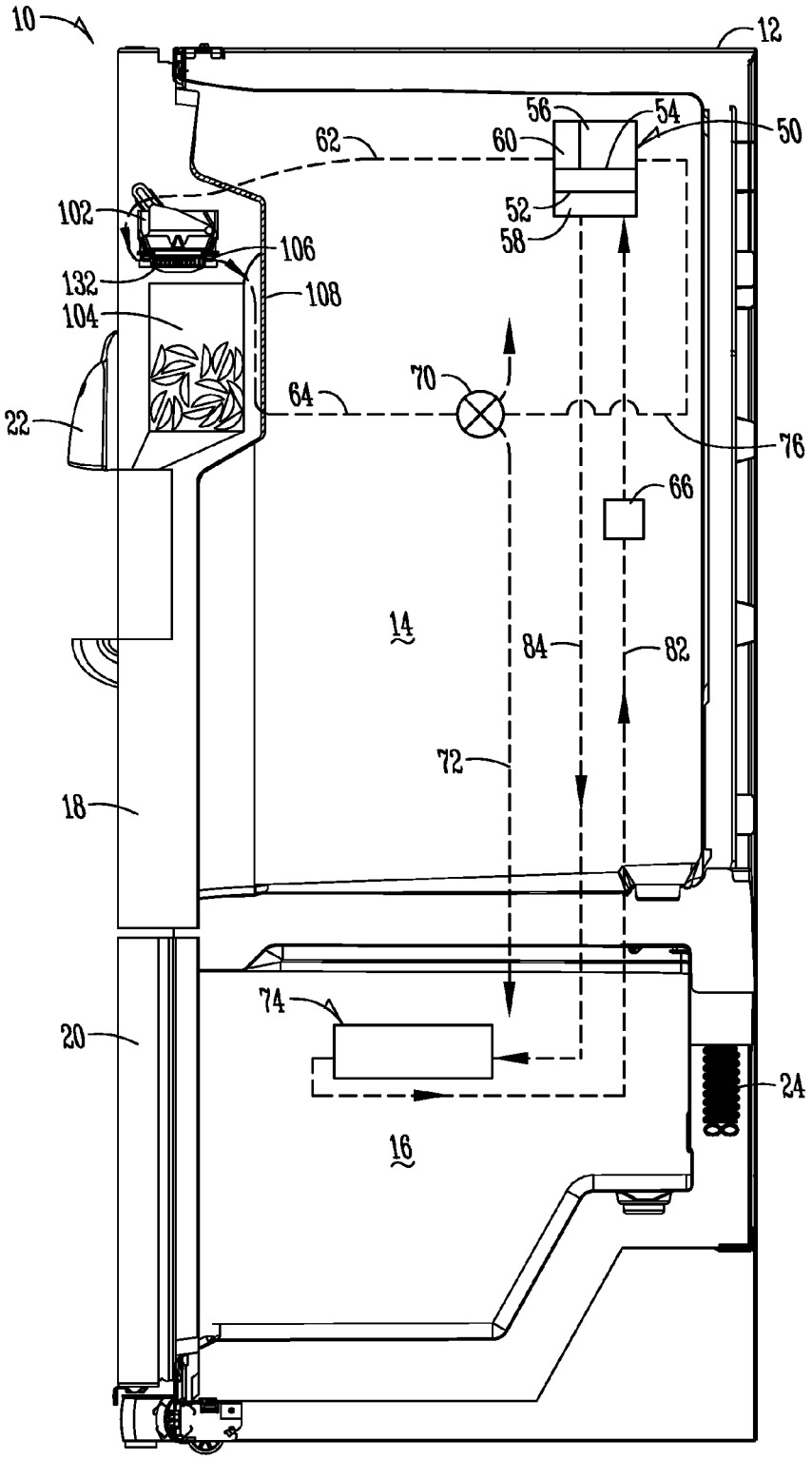
FIG. 3 is a side elevation view showing a sectional of another exemplary aspect of the refrigerator illustrated in FIG. 1.
Figure 4:
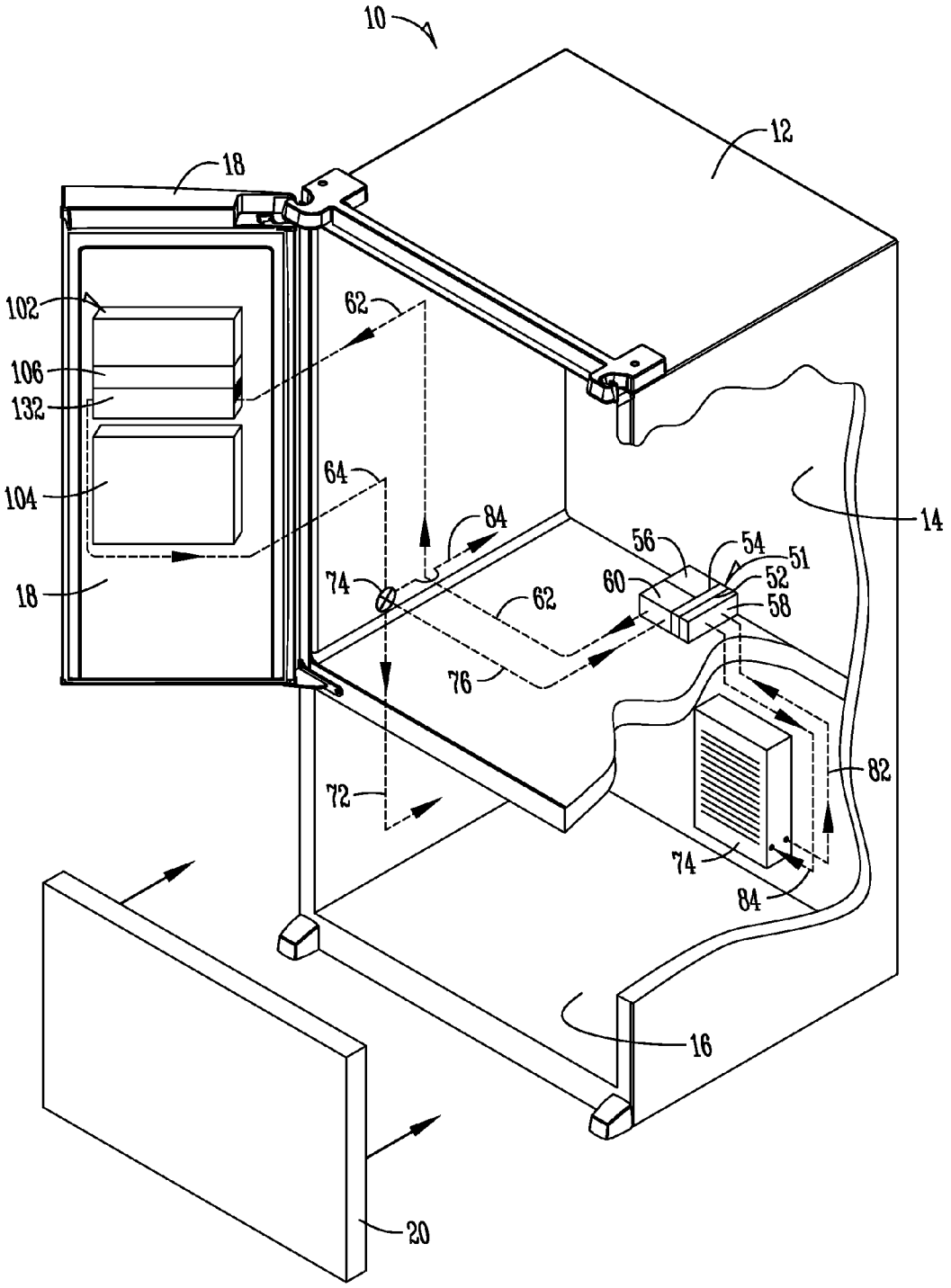
FIG. 4 is a perspective view showing a cutout illustrating an exemplary configuration of the refrigerator.
Figure 5:
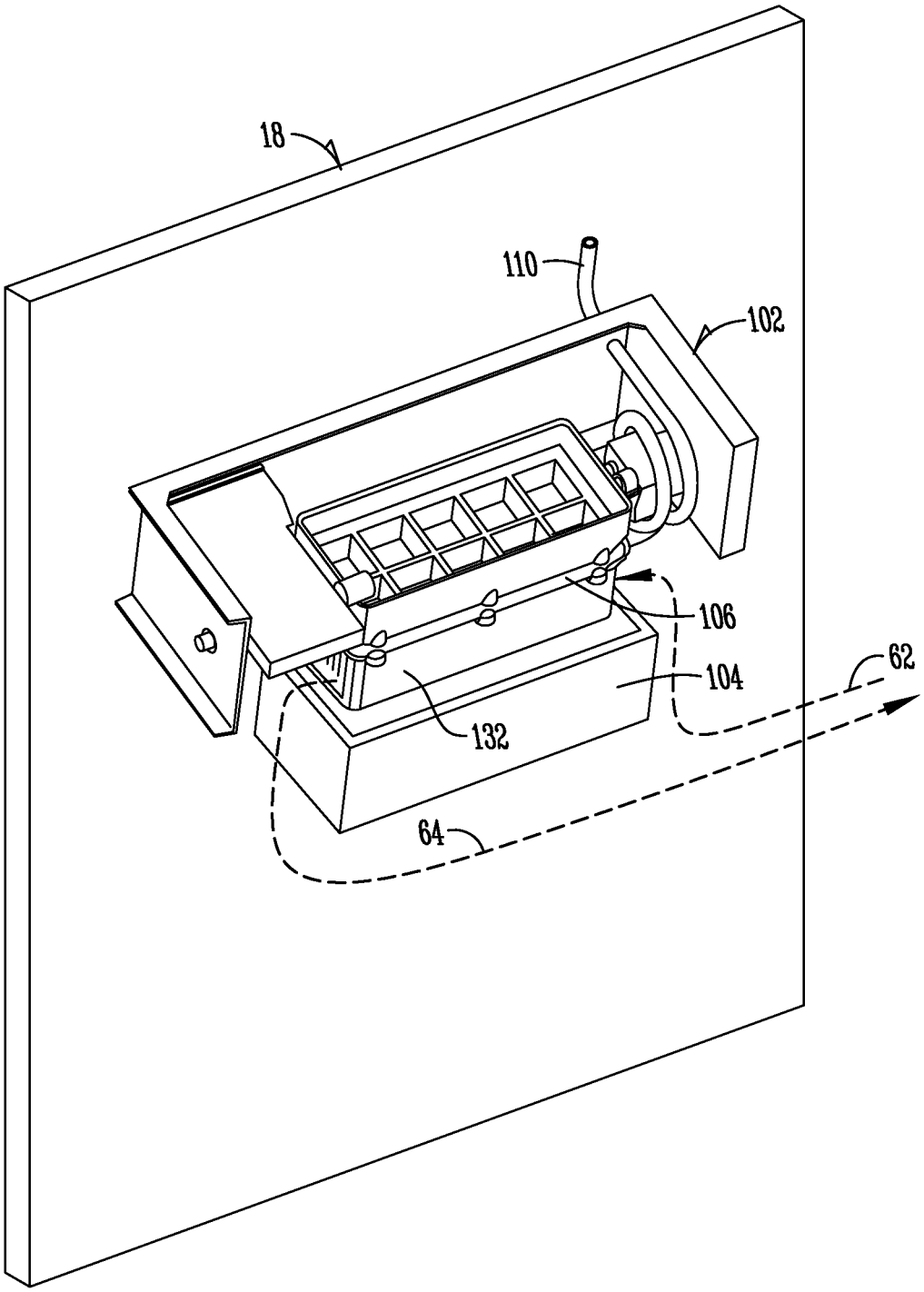
FIG. 5 is a perspective view of an exemplary configuration for the inside of a refrigerator compartment door.

In the case where air is used as the heat carrying medium, an air supply pathway 62 may be connected between the air sink 56 and the icemaker 102 in the insulated compartment 108 on the refrigerator compartment door 18. As shown for example in FIG. 2, a fan 60 may be configured to move air from the air sink 56 through the air supply pathway 62 to the icemaker 102. The cold air in the pathway is communicated through the air sink 132 in thermal contact with the ice mold 106. Heat coming off the warm side 52 of the thermal electric device 50 may be extracted using cold from the freezer compartment 16. For example, in one aspect of the refrigerator 10, a fluid supply pathway 82 is connected between an evaporator 24 (or a secondary evaporator) and a fluid sink 58 in thermal contact with the warm side 52 of the thermal electric device 50. A fluid return pathway 84 may be connected between the evaporator 24 (or a secondary evaporator) and the fluid sink 58 in thermal contact with the warm side 52 of the thermal electric device 50. The fluid supply pathway 82 and the fluid return pathway 84 may be configured as a fluid loop between the evaporator 24 and the fluid sink 58 for extracting heat off of the warm side 52 of the thermal electric device 50. A pump 66 may be configured in the fluid loop for moving a cooling fluid (e.g., ethylene glycol or ethylene propylene) from the evaporator to and from the evaporator 24 between the fluid sink 58. Alternatively, as illustrated in FIG. 3, a cold battery or cold reservoir of cooling fluid may be positioned within the refrigerator compartment 14. In one aspect of the refrigerator 10, the heat exchanger 74 is positioned within the freezer compartment 16. The heat exchanger 74 may also include a fluid reservoir of fluid such as ethylene glycol or ethylene propylene. The heat exchanger 74 may also comprise a cold battery having a fluid reservoir and the potential of storing a fluid such as ethylene glycol or ethylene propylene at a temperature at or below freezing. Similar to the configuration using the evaporator 24 shown in FIG. 2, the heat exchanger 74 may be connected to the fluid sink 58 by a fluid supply pathway 82 and a fluid return pathway 84. The fluid supply pathway 82 and the fluid return pathway 84 may be configured as a loop for moving fluid from the heat exchanger 74 to the fluid sink 58. A pump 66 may be configured to move fluid through the fluid supply pathway 82 and fluid return pathway 84 between the fluid sink 58 and the heat exchanger 74 positioned in the freezer compartment 16. The fluid in the loop is chilled to the temperature of the freezer compartment and used to extract heat off of the warm side 52 of the heat exchanger 50 which is then returned to the heat exchanger 74 positioned in the freezer compartment 16. For example, if the freezer compartment 16 is set at 20° Fahrenheit, the warm side 52 of the heat exchanger 50 may be kept at or near 20° Fahrenheit and the cold side of the heat exchanger 50 may be generally around 20° Fahrenheit depending upon the flowrate of fluid from the freezer compartment 16. In the case where the heat exchanger 50 comprises a TEC device, the cold side 54 of the thermoelectric device 50 may be then kept at 20° Fahrenheit minus the delta of the thermoelectric device 50. For example, if the thermoelectric device has a delta of 20°, the cold side 54 may be kept at a temperature of 0° Fahrenheit. The air from the air sink 56 is then cooled to at or near 20° Fahrenheit when a heat exchanger is used or 0° Fahrenheit when a TEC device is used. The fan 60 moves the cold air from the air sink 56 to the icemaker 102 through the air supply pathway 62 as previously indicated. The cold air passes through an air sink 132 in thermal contact with the ice mold 106 for extraction heat from the ice mold for making ice. The air passes through the air sink 132 in thermal contact with the ice mold 106 through an air return pathway 64 and may be configured to distribute return air into the refrigerator compartment 14 or the freezer compartment 16. A flow controller 70 may be configured into the air return pathway 64 for metering or baffling the air into the refrigerator 14 or the freezer compartment 16. Alternatively, the air return pathway 64 may be connected to the air sink 56 in the refrigerator compartment 14. The air supply pathway 62 and the air return pathway 64 may be configured to create an air loop between the air sink 56 connected in thermal contact with the cold side 54 of the heat exchanger 50 and the air sink 132 connected in thermal contact with the ice mold 106 in the icemaker 102. Alternatively, a TEC device may be connected with its cold side 54 in thermal contact with the ice mold 106. An air sink may be connected in thermal contact with the warm side of the TEC device. An air pathway may be configured between an air sink (not shown) in thermal contact with the warm side of the TEC device and the heat exchanger 50 positioned within the refrigerator compartment 14. Cold fluid from a heat exchange, such as heat exchanger 74 positioned in the freezer compartment 16 or an evaporator may be communicated to the heat exchanger in the refrigerator compartment for extracting heat from off the warm side of the heat exchanger. The sub-zero cooling potential communicated from the heat exchanger 50 in the refrigerator compartment 14 may be carried by air or fluid to a TEC device connected in thermal contact with the ice mold 106 of the icemaker 102 in the refrigerator compartment door 18. For example, a fluid loop may be configured to communicate cooling fluid from the heat exchanger 50 in the refrigerator compartment 14 to the ice mold 102. Alternatively, an air loop may be configured to communicate cool air from the heat exchanger 50 in the refrigerator compartment 14 to the ice mold 106. A TEC device (not shown) having a cold side 54 in thermal contact with the ice mold 106 may be cooled by fluid or air taken from the heat exchanger 50 within the refrigerator compartment 14 where the exchange is provided by a cooling loop connected between a heat exchanger 74 or an evaporator 24 in the freezer compartment 16. As is illustrated in FIG. 4, a refrigerator 10 may be configured with a thermoelectric device 51 positioned within the refrigerator compartment 14. The thermoelectric device 51 includes a warm side 52 and a cold side 54. The warm side is in thermal contact with a fluid sink 58. Sub-zero fluid is communicated through a fluid loop in communication with a heat exchanger 74 positioned in the freezer compartment 16 to the fluid sink 58 in thermal contact with the warm side 52 of the thermoelectric device 51 in the refrigerator compartment 14. An air sink 56 is configured in thermal contact with the cold side 54 of the thermoelectric device 51. A fan may be operably arranged to move air from the cold side 54 of thermoelectric device 51 through the air sink 56. The cold air is passed through an air supply pathway 62 passing through the refrigerator compartment to the refrigerator compartment door 18. The air supply pathway 62 may be configured in a duct in a sidewall, a mullion or separate enclosure within the cabinet body defining the refrigerator compartment 14. An air supply pathway exchange between the refrigerator compartment door 18 and the refrigerator compartment 14 may be configured to allow air to pass through from the refrigerator compartment to the door when the door is closed. Alternatively, a flexible conduit or other carrier may be configured between the cabinet and the door to allow air to be moved from the refrigerator compartment to the refrigerator compartment door 18. An air sink 132 is connected in thermal contact with the ice mold 106 of the icemaker 102. Cold air passing through the air supply pathway 62 extracts heat from the air sink 132 which freezes the air in the ice mold 106 as illustrated in FIG. 5. A separate air return pathway 64 may also be configured with a junction across the door between the door and the cabinet to transfer return air from the air sink 132 to the air sink 56 in thermal contact with the cold side 54 of the thermoelectric device 51 in the refrigerator compartment. A flow controller 74 may be configured to distribute air into the refrigerator compartment via air return pathway 64, and into the freezer compartment via air return pathway 72 or through a loop configuration via air return pathway 76 connected in communication with the air sink 56. A fan 60 may be used to communicate air through the air supply pathway 62 and air return pathway 64. As previously indicated, the thermoelectric device 51 may be positioned on the door at the icemaker 102 so that the cold side 54 is in thermal contact with the ice mold and the warm side 52 is in thermal contact with an air sink. Cold air from a heat exchanger positioned within the refrigerator compartment may be used to cool the air sink in thermal contact with the ice mold. The heat exchanger in the refrigerator compartment may be cooled by a fluid loop connected to a heat exchanger or evaporator in the freezer compartment as previously discussed.

Figure 6:
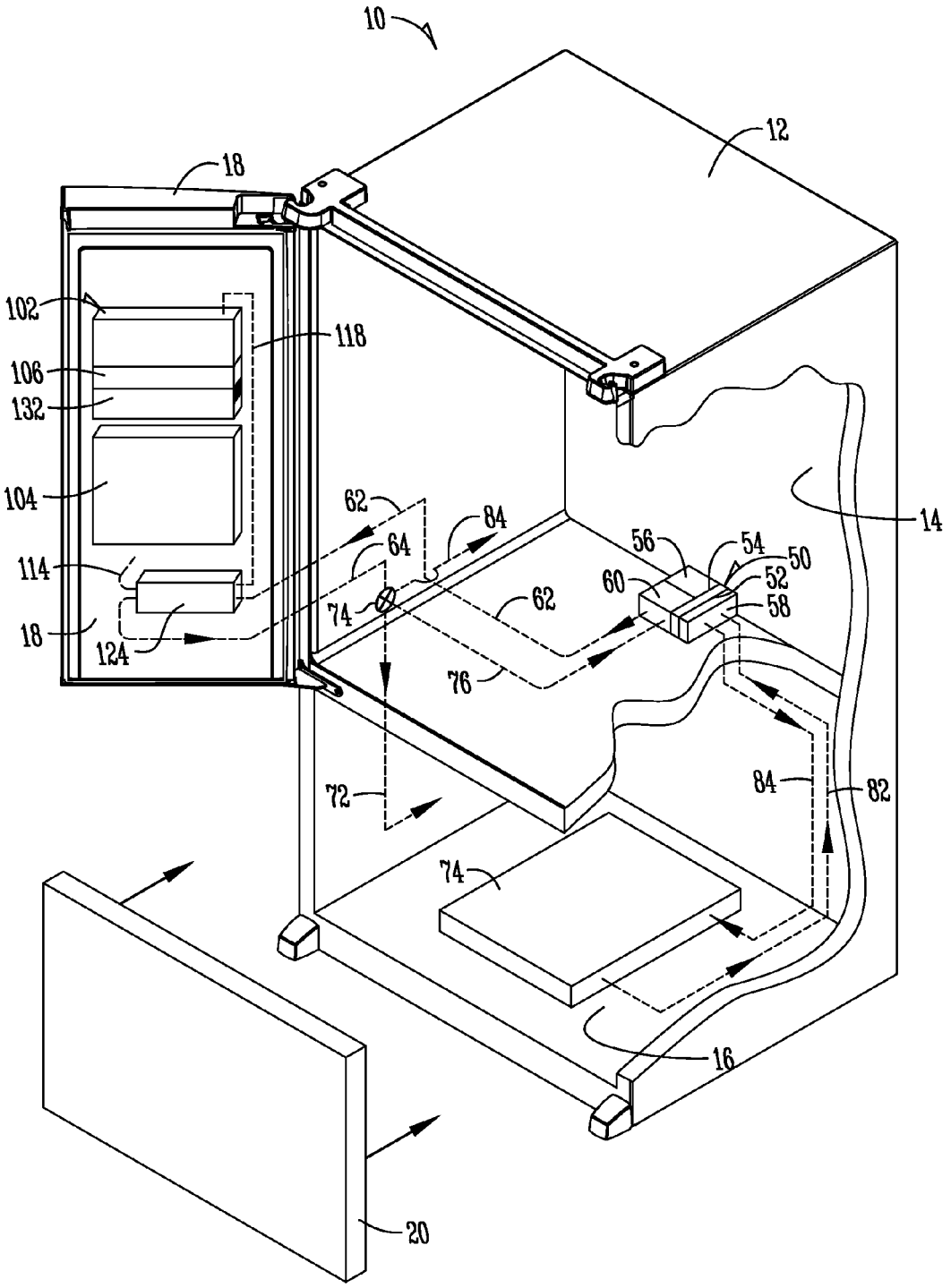
FIG. 6 is a perspective view with a cutout for illustrating another exemplary configuration of the refrigerator.

FIG. 6 illustrates another exemplary aspect of refrigerator 10. In FIG. 6, a heat exchanger 50 may be positioned within the refrigerator compartment 14 or within the insulated compartment 108 on the refrigerator compartment door according to the embodiments previous discussed. Cool air or cool liquid may be communicated from the thermoelectric sub-zero exchange to a cooling application 124 located on the refrigerator compartment door 18 or within the refrigerator compartment 14. The cooling application 124 may include a fluid sink 58 extracting heat from a water reservoir for chilling the water in the reservoir to the temperature of the air or liquid in the supply pathway 62 received from the thermoelectric exchange. The water in the cooling application 124 may be drinkable or consumable or used for consumable purposes. The water reservoir may be chilled and dispensed from the cooling application 124 through a fluid supply pathway 114 to the dispenser 22 for dispensing chilled liquid from the refrigerator compartment door 18. Alternatively or additionally, chilled water may be dispensed from the cooling application 124 through fluid supply pathway 118 to the icemaker 102 to fill the ice mold 106 with pre-chilled water to reduce the amount of energy and time required to make ice. The configuration illustrated in FIG. 6 may also be used to provide a heating application the refrigerator compartment door 18 or within the refrigerator compartment 14. Using a TEC device in place of the heat exchanger 50 and by reversing the polarity of the TEC device the air or liquid in the supply pathway 62 may be heated and used at the application 124 for heating a reservoir of water. The warm reservoir of water may be used to provide warm water at the dispenser 22 or warm water at the icemaker 102 via supply pathway 114 and supply pathway 118, respectively. The warm water at the dispenser may be used for warm liquid drinks and the warm water at the icemaker 102 may be used to purge the ice mold 106.

Figure 7:
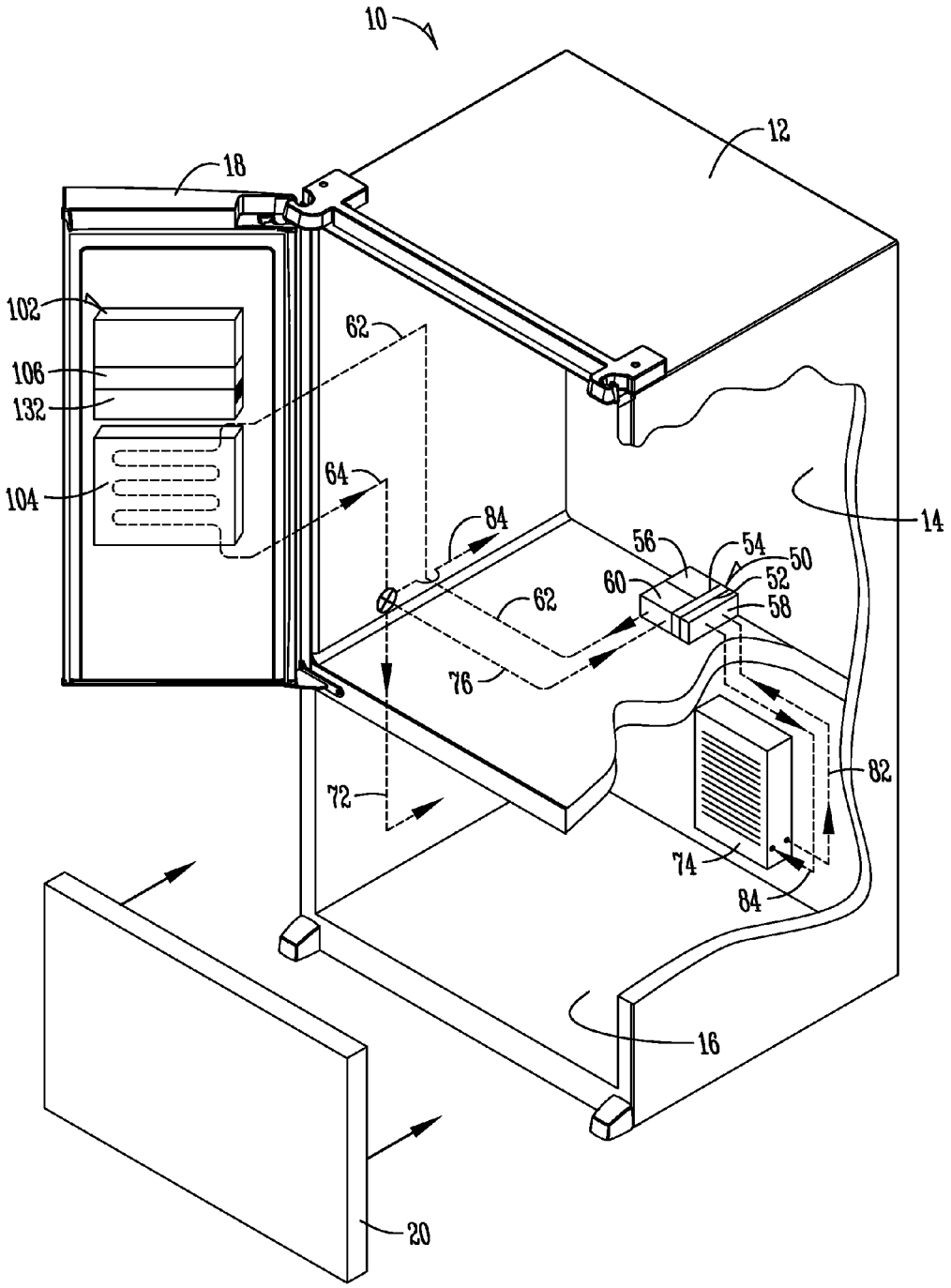
FIG. 7 is perspective view with a cutout for illustrating other exemplary configurations of the refrigerator.

In another aspect of the refrigerator 10, as illustrated in FIG. 7, the ice storage bin 104 may be chilled or warmed using the exchange process previously described. For example, a heat exchanger 50 may be positioned within the refrigerator compartment 14 or on the refrigerator compartment door 18. A supply pathway 62 may be connected to the thermoelectric exchange for supplying cold or warm air or liquid to the ice storage bin 104 on the refrigerator compartment door 18. The fluid or air in the supply pathway 62 may be used to heat or cool the ice storage bin 104. For example, cold air pulled from off the cold side 54 of the heat exchanger 50 may be used to chill the ice storage bin 104 in addition to extracting heat off of the air sink 132 in thermal contact with the ice mold 106. A flow controller may be configured to control the flow of cold air to the air sink 132 and the ice storage bin 104 to support the desired rate of ice production and the desired temperature of the ice storage bin 104. In one aspect of the invention, sub-zero air is communicated from the heat exchanger 50 through the air supply pathway 62 to the ice storage bin 104 for keeping the ice in the bin at freezing temperatures. Liquid may also be used to harvest heat from the ice mold 106 and from the ice storage bin 104 for chilling both. For example, a fluid sink may be connected in thermal contact with the cold side 54 of the heat exchanger 50 and a pathway may be connected between the fluid sink and a fluid sink in thermal contact with the ice mold 106 and fluid loop in the ice storage bin 104 for chilling the ice bin and extracting heat from the fluid sink in thermal contact with the ice mold 106 for making ice. Using a TEC device in place of the thermal exchanger 50 and by reversing the polarity of the TEC device, warm air or fluid may be communicated through the supply pathway 62 to warm the ice storage bin 104 for creating fresh ice and cold ice melt drained from the ice storage bin 104 through a drain (not shown). The warm air fluid may also be communicated from the TEC device to the icemaker 102 for ice harvesting. For example, warm air may be used to warm the ice mold 106 or warm fluid may be used to warm a fluid sink for warming ice mold 106 during the ice harvesting process. As previously indicated, the heat exchanger 50 may be positioned on the refrigerator compartment door 18 or within the refrigerator compartment 14. An air fluid exchange may be configured between the door and the cabinet to allow the transfer of cold air from the heat exchanger 50 in the refrigerator compartment 14 to a TEC device (not shown) on the refrigerator compartment door 18. Sub-zero fluid taken from the freezer compartment or evaporator may be used to chill the heat exchanger 50 in the refrigerator compartment for providing cold air or liquid to a cooling application on the door as previously indicated. Alternatively, warm air may be provided to a warming application on the door 18 or within the refrigerator compartment 14 by replacing a heat exchanger on the door 18 with a TEC device that is operated in reverse polarity.

Figure 8:
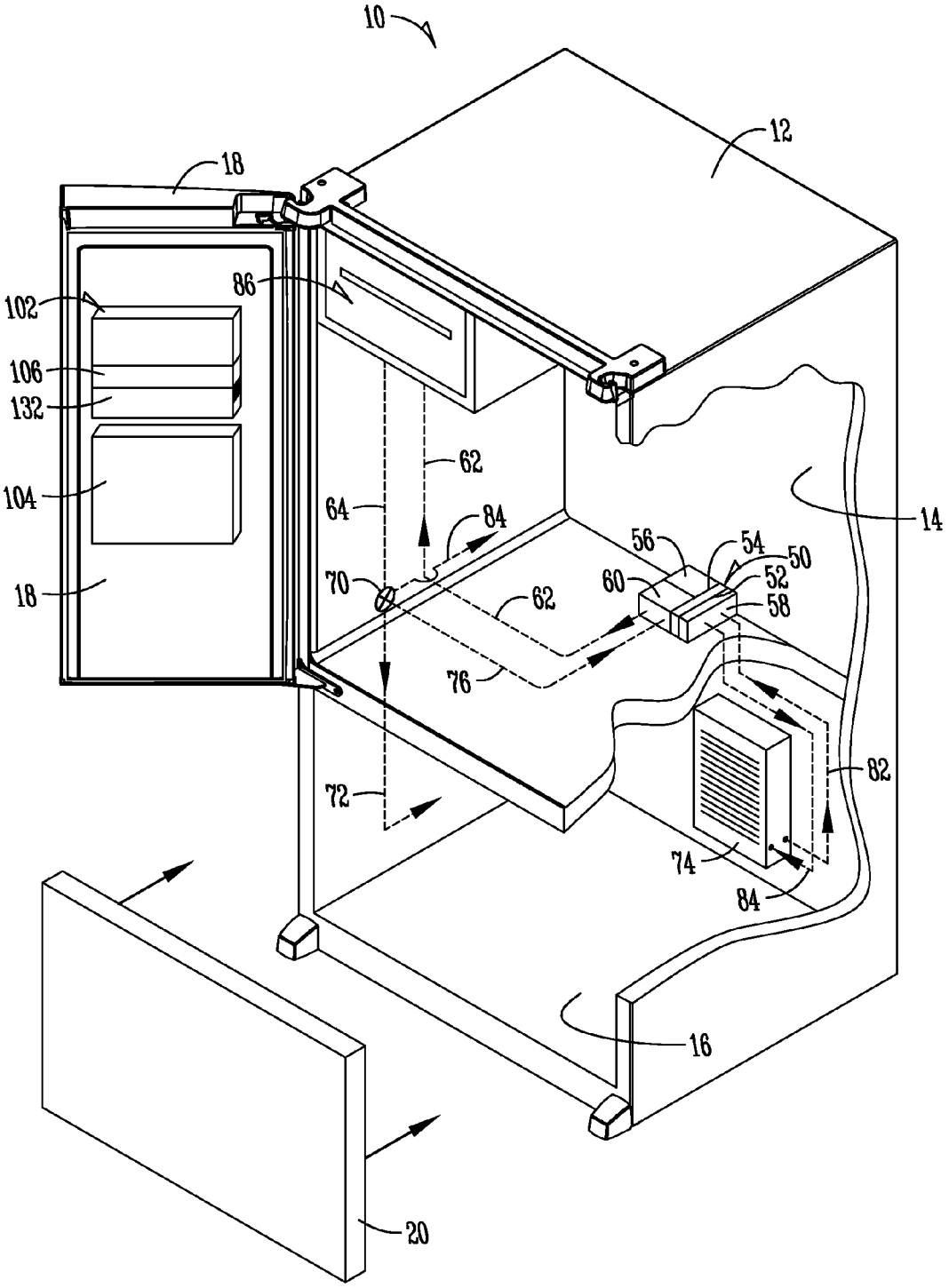
FIG. 8 is perspective view with a cutout for illustrating another exemplary embodiment for the refrigerator.

According to another aspect of the refrigerator 10 illustrated in FIG. 8, a sub-zero cooling application may also be provided within the refrigerator compartment 14. For example, a module, cabinet, drawer, isolated space (insulated from the refrigerator compartment) may be configured within the refrigerator compartment 14. The supply pathway 62 may be connected between the heat exchanger 50 and the sub-zero application 86 for providing sub-zero air or liquid to the application through the exchange process using sub-zero liquid taken from the freezer compartment 16 or evaporator 24. Alternatively, a TEC device may be configured to replace the heat exchanger 50 and operated in reverse polarity to provide a warming application within the refrigerator compartment 14. For example, an isolated drawer, cabinet, module or other enclosure insulated or non-insulated may be configured within the refrigerator compartment 14 to receive warm air or fluid from a TEC device housed within the refrigerator compartment 14. A pathway 62 for providing warm or cold air or liquid to the application 86 may be configured between the application 86 and the TEC device (not shown, but would generally replace heat exchanger 50). A return pathway 64 may also be configured between the application 86 and the TEC device. A flow controller 70 may be configured within the return pathway 64 for distributing return air to the refrigerator compartment 14 via air return pathway 84 or to the freezer compartment 16 via air return pathway 72. The return pathway 64 may also be a fluid return pathway for returning fluid to the thermoelectric device. The supply pathway 62 and return pathway 64 may be configured as a fluid loop between the heat exchanger 50 or a TEC device and the application 86.

Figure 9:
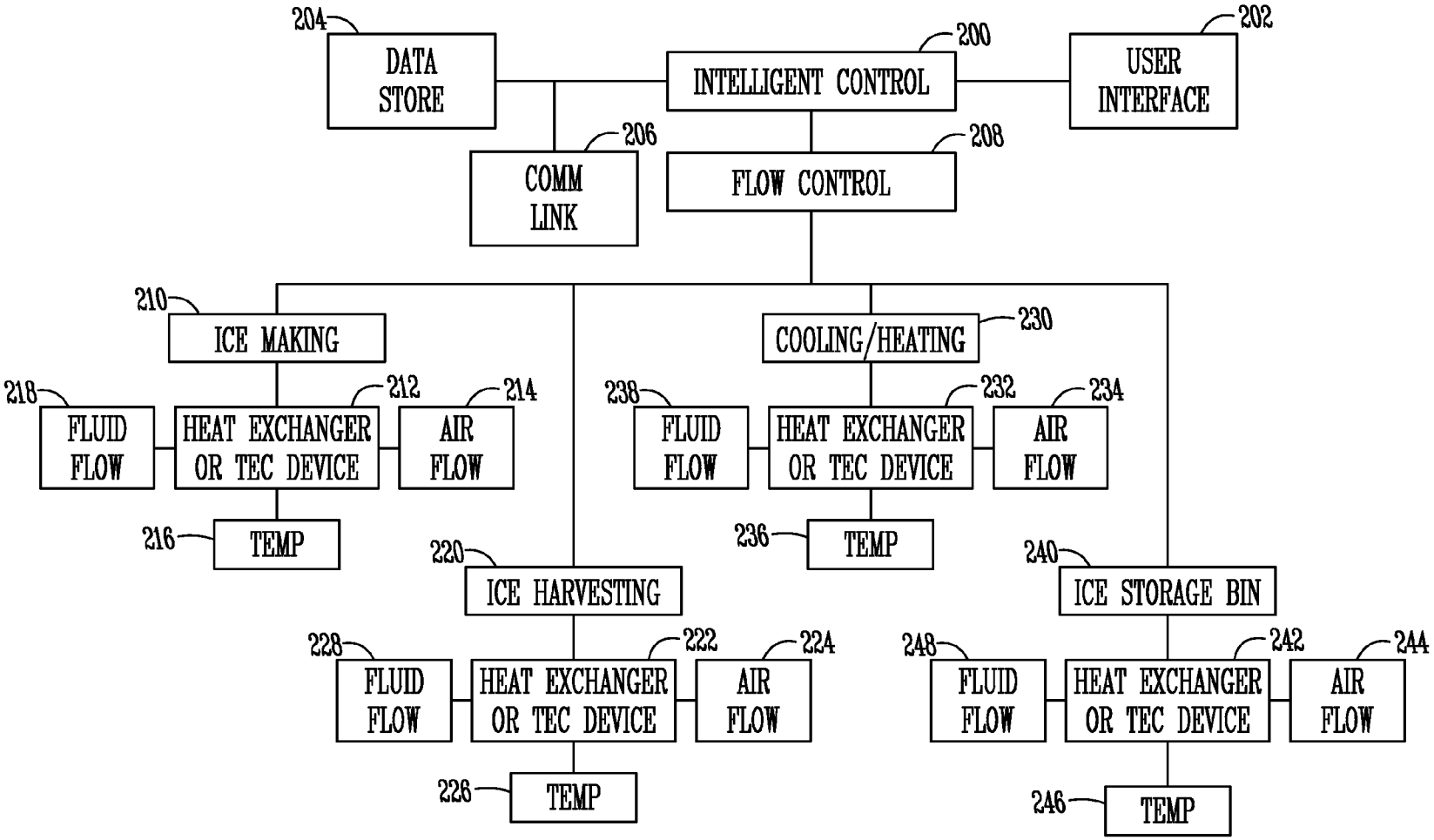
FIG. 9 is a flow diagram illustrating a process for intelligently controlling one or more operations of the exemplary configurations and embodiments of the refrigerator.

FIG. 9 provides a flow diagram illustrating control processes for exemplary aspects of the refrigerator. To perform one or more aforementioned operations or applications, the refrigerator 10 may be configured with an intelligent control 200 such as a programmable controller. A user interface 202 in operable communication with the intelligent control 200 may be provided, such as for example, at the dispenser 22. A data store 204 for storing information associated with one or more of the processes or applications of the refrigerator may be provided in operable communication with the intelligent control 200. A communications link 206 may be provided for exchanging information between the intelligent control 200 and one or more applications or processes of the refrigerator 10. The intelligent control 200 may also be used to control one or more flow controllers 208 for directing flow of a heat carrying medium such as air or liquid to the one or more applications or processes of the refrigerator 10. For example, in an ice making application 210, the flow controller 208 and intelligent control 200 may be configured to control and regulate fluid flow 218 between a thermoelectric (TEC) device process 212 at the ice making application 210 from a heater exchanger process 212 in the refrigerator compartment 14. Air flow 214 may also be controlled and regulated by the intelligent control 200 operating one or more flow controllers 208 for controlling air flow 214 from a heat exchanger process 212 in the refrigerator compartment 14 on to the refrigerator compartment door 18 to a heat exchanger process 212 in thermal contact with the ice making application 210. In another application, fluid flow 218 from a heat exchanger 212 within the refrigerator compartment 18 may be communicated to a TEC device process 212 on the refrigerator compartment door 18. Fluid flow 218 may also be controlled from the cabinet across to the door from a thermoelectric device process 212 in the refrigerator compartment 14 to a heat exchanger 212 located on the refrigerator compartment door 18. The heat exchanger may be configured in thermal contact with the ice making application 210 for extracting heat to make ice. The heat exchanger process 212 in the refrigerator compartment 14 may be cooled or chilled by fluid flow 218 from the freezer compartment 16. For example, the temperature 216 of the freezer compartment 16 may be communicated in a fluid flow 218 to a heat exchanger 212 in the refrigerator compartment 14 which is in turn communicated by air flow 214 from the refrigerator compartment 14 to the refrigerator compartment door 18 for facilitating the ice making application 210. Alternatively, the TEC device process 212 may be positioned on the refrigerator compartment door 18. A fluid flow 218 or air flow 214 communicates cold air or warm air, cold fluid or warm fluid to the ice making application 210. The intelligent control 200 may be configured to control one or more flow controllers 208 for controlling the flow of air or fluid from the TEC device process 212 to a heat exchanger 212 in thermal contact with the ice making application 210. For example, in one mode the thermoelectric device process 212 may be configured to communicate a warm temp 216 air flow 214 to a heat exchanger 212 in thermal contact with the ice making application 210. In another aspect, the TEC device process 212 may be configured to another mode to communicate cold air flow 214 to a heat exchanger 212 in thermal contact with the ice making application 210. Alternatively, the TEC device process 212 may be configured to communicate warm temp 216 air flow 214 or warm temp 216 fluid flow 218 from the TEC device process 212 to a heat exchanger 212 in thermal contact with the ice making application 210. The intelligent control 200 may be configured to control the rate of delivery of air flow 214 and/or fluid 218 by actuation of one or more flow controllers 208. The temperature 216 of the air flow 214 and/or fluid flow 218 to the heat exchanger 212 in thermal contact with the ice making application 210 may be controlled by operating or by controlling the TEC device process 212. Air flow 214 or fluid flow 218 may be also communicated from the heat exchanger 212 in the refrigerator compartment 14 to the thermal electric device process 212 on the refrigerator compartment door 18. The rate of air flow 214 and/or fluid flow 218 from the refrigerator compartment 14 to the refrigerator compartment door 18 (e.g., the ice making application) may be controlled by one or more flow controllers 208 under operation of the intelligent control 200. Thus, a sub-zero fluid exchange from the freezer compartment 16 to the refrigerator compartment 14 may be used to cool a heat exchanger 212 in the refrigerator compartment 14. A sub-zero air exchange from the heat exchanger 212 in the refrigerator compartment may be configured to transfer sub-zero air from the refrigerator compartment 14 to a TEC device process 212 on the refrigerator compartment door 18. Air flow 214 or fluid flow 218 may be communicated from the TEC device process 212 to the ice making application 210. Alternatively, a fluid flow 218 may be taken from the freezer compartment 16 to the refrigerator compartment 14 for cooling a TEC device process 212 in the refrigerator compartment 14. A fluid or air loop (e.g., a fluid flow 218 or air flow 214) may be configured between the TEC device process 212 and the refrigerator compartment 14 to a heat exchanger 212 on the refrigerator compartment door 18 in thermal contact with the ice making application 210. In another aspect, a fluid loop from the freezer compartment may be configured for fluid flow 218 to a TEC device process 212 in the refrigerator compartment for providing fluid flow 218 from the refrigerator compartment 14 to the refrigerator compartment door 18 having the ice making application 210.

In another aspect of the invention, the intelligent control 200 operating one or more flow controllers 208 may be used for ice harvesting 220. For example, a TEC device process 222 may be configured in thermal contact with the ice harvesting application 220. Reversing the polarity of the TEC device process 222 may be used to warm the temperature 226 of the ice mold for facilitating ice harvesting application 220. In another aspect, a TEC device process 222 may be configured in the refrigerator compartment door 18 for communicating a warm fluid flow 228 or warm air flow 224 to the ice harvesting application 220 for increasing the temperature 226 of the ice mold. Alternatively, a TEC device process 222 may be positioned within the refrigerator compartment 14. A fluid or air exchange may be configured between the TEC device process 222 in the refrigerator compartment 14 and the ice harvesting application 220 on the refrigerator compartment door 18. Operating the TEC device process 222 in reverse polarity warms the fluid flow 228 or air flow 224 communicated to the ice harvesting application 222. The temperature 226 of the ice mold is warmed to facilitate the ice harvesting application 220. An intelligent control 200 may be configured to control one or more flow controllers 208 for controlling the rate of fluid flow 228 or air flow 224 from the TEC device process 222 to the ice harvesting application 220 on the refrigerator compartment door 18.

In another aspect of the invention, the intelligent control 200 may be configured to control one or more flow controllers 208 for supporting a cooling or heating application 230 on the refrigerator compartment door 18 or in the refrigerator compartment 14. For example, the heat exchanger 232 in the refrigerator compartment 14 may be configured to transfer a refrigerator compartment temperature 236 air flow 234 or fluid flow 238 to a cooling application 230 on the refrigerator compartment door 18. The temperature 236 of the cooling or heating application 230 on the refrigerator compartment door 18 may be controlled by communicating air flow 234 or fluid flow 238 from the refrigerator compartment 14 or from a heat exchanger 232 in the refrigerator compartment 14. The temperature 236 of a fluid flow 238 or air flow 234 may be communicated from a thermoelectric TEC device process 232 connected in communication with a cooling and/or heating application 230 on the refrigerator compartment door 18 or in the refrigerator compartment 14. Air flow 234 or fluid flow 238 from a TEC device process 232 may be used to cool or heat an application 230 on the refrigerator compartment door 18. For example, operating the TEC device process 232 in reverse polarity a warm temperature 236 air flow 234 or fluid flow 238 may be communicated to a warming or heating application on the refrigerator compartment door 18. For example, water may be heated to provide a warm water supply to the dispenser 22 on the refrigerator 10. Warm water may also be heated to purge the ice making application 210. Alternatively, the TEC device process 232 may be configured to cool the temperature 236 of an air flow 234 or fluid flow 238 for a cooling application 230. The intelligent control 200 may control one or more flow controllers 208 for controlling the rate of flow of fluid flow 238 or air flow 234 to the cooling application 230. For example, the cooling application may be used to cool a reservoir of water for providing chilled water at the dispenser 22 of the refrigerator 10. Chilled water may also be communicated from the cooling application 230 to the ice making application 210 for providing pre-chilled water for making ice. In another aspect of the invention, the intelligent control 200 may be used to control one or more flow controllers 208 for managing the temperature 246 of the ice storage bin 240. In one aspect, a warm or cool temperature 246 fluid flow 248 or air flow 244 may be communicated from a TEC device process 242 to the ice storage bin application 240 for warming the ice bin or chilling the ice bin. In the warming mode the ice in the ice bin is melted to provide a fresh ice product and in the cooling mode the ice in the ice bin is kept frozen. The TEC device process 242 may be operated to provide a warm temperature 246 fluid flow 248 or air flow 244 to the ice storage bin 240. In reverse polarity the TEC device process 242 may be operated to provide a cool fluid flow 248 or cool temperature 246 air flow 244 to the ice storage bin 240 for keeping the ice frozen. In another aspect of the refrigerator 10, the intelligent control 200 may be used to control the flow controller 208 for metering the fluid flow 248 or air flow 244 from a heat exchanger 242 in the refrigerator compartment 14 to the ice storage bin 240 in the refrigerator compartment door 18. The warmer refrigerator compartment air may be used to raise the temperature 246 of the ice storage bin 240 for providing a fresh ice product. In another aspect, sub-zero freezer compartment 16 air flow 244 or fluid flow 248 may be used to cool a heat exchanger 242 in the refrigerator compartment 14 which is in turn used to chill the ice storage bin 240 in the refrigerator compartment door 18. The chilled air flow 244 or fluid flow 248 may be communicated from the refrigerator compartment 14 to the refrigerator compartment door 18 for chilling the ice storage bin 240. The cooling potential from the freezer compartment 16 may be communicated directly from the freezer compartment 16 to the refrigerator compartment door 18 for chilling the ice storage bin 240 or through the refrigerator compartment 14 via a heat exchanger 242. This sub-zero cooling potential from the freezer compartment may be communicated directly to the refrigerator compartment door 18 or through the refrigerator compartment 14 via a fluid flow 248 or air flow 244. In one aspect, fluid flow 248 or air flow 244 from the freezer compartment 16 may be used to keep the ice storage bin 240 at a temperature 246 below freezing. In another aspect, refrigerator compartment air may be used to keep the temperature 246 of the fluid flow 248 or air flow 244 to the ice storage bin 240 at a temperature above freezing to provide a fresh ice product. Thus, one or more aspects for controlling the temperature of one or more applications and methods, such as for example, an ice making, ice harvesting, cooling/heating, and ice storage bin application on a refrigerator, are provided.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. For example, the exact location of the thermoelectric device, air or fluid supply and return pathways may be varied according to type of refrigerator used and desired performances for the refrigerator. In addition, the configuration for providing heating or cooling on a refrigerator compartment door using a thermoelectric device may be varied according to the type of refrigerator and the location of the one or more pathways supporting operation of the methods. It is understood that any other modifications, substitutions, and/or additions may be made, which are within the intended spirit and scope of the disclosure. From the foregoing, it can be seen that the exemplary aspects of the disclosure accomplishes at least all of the intended objectives.

What is claimed is:

1. A refrigerator that has a fresh food compartment, a freezer compartment, and a door that provides access to the fresh food compartment, the refrigerator comprising:

an icemaker mounted remotely from the freezer compartment, the icemaker including an ice mold;

an air supply pathway in communication between the icemaker and the fresh food compartment;

a fan positioned to move air from the fresh food compartment through the air supply pathway;

a thermoelectric device positioned in the fresh food compartment in communication with the air supply pathway, said thermoelectric device mounted remotely from the ice mold; and a flow pathway in communication between the thermoelectric device and the freezer compartment.

2. The refrigerator of claim 1 further comprising an air return pathway in communication between the icemaker and the thermoelectric device for exhausting air from the icemaker to the thermoelectric device.

3. The refrigerator of claim 1 wherein the air supply pathway comprises an air flow loop in communication between the icemaker and the thermoelectric device.

4. The refrigerator of claim 1 wherein the flow pathway comprises a fluid loop in communication between the thermoelectric device and the freezer compartment for supplying cold fluid to the thermoelectric device.

5. The refrigerator of claim 1 wherein the flow pathway comprises a fluid loop in communication between the thermoelectric device in the fresh food compartment and a heat exchanger in a freezer evaporator.

6. The refrigerator of claim 1 further comprising:

an insulated compartment on the door;

an ice storage bin in the insulated compartment positioned to receive ice harvested from the ice mold; and the thermoelectric device in thermal communication between the insulated compartment and the freezer compartment for supplying cold air to the insulated compartment.

7. The refrigerator of claim 1 wherein the air supply pathway is in communication between the ice mold in the fresh food compartment and the thermoelectric device for supplying cold air to the ice mold.

8. The refrigerator of claim 1 further comprising a secondary heat exchange interface in the flow pathway from the freezer compartment for supplying cold to the thermoelectric device in the fresh food compartment.

9. The refrigerator of claim 1 further comprising an air return pathway in communication between the icemaker and the fresh food compartment for exhausting air from the icemaker to the fresh food compartment.

10. The refrigerator of claim 1 further comprising an air return pathway in communication between the icemaker and the freezer compartment for exhausting air from the icemaker to the freezer compartment.

11. The refrigerator of claim 1 further comprising:

an insulated compartment on the door;

an ice storage bin in the insulated compartment positioned to receive ice harvested from the ice mold; and the air supply pathway in communication between the fresh food compartment and the insulated compartment for supplying air to the insulated compartment.

12. The refrigerator of claim 1 wherein the icemaker is mounted on the fresh food compartment door.

13. The refrigerator of claim 1 further comprising:

a water reservoir or line connected in fluid communication with the icemaker; and the air supply pathway in communication between the fresh food compartment and the water reservoir or line for chilling the water supplied to the icemaker.

14. The refrigerator of claim 13 further comprising a water dispenser in fluid communication with the water reservoir or line for dispensing chilled water from the water dispenser.

15. A refrigerator that has a fresh food compartment, a freezer compartment, and a door that provides access to the fresh food compartment, the refrigerator comprising:

a thermoelectric device disposed in the fresh food compartment;

an air supply pathway between the thermoelectric device and an icemaker, said air supply pathway for supplying cold air to an ice mold in the icemaker, said icemaker mounted remotely from the freezer compartment, and said thermoelectric device mounted remotely from the ice mold; and a fluid supply pathway between the thermoelectric device and the freezer compartment for supplying cold fluid to the thermoelectric device.

16. The refrigerator of claim 15 further comprising:

an insulated compartment;

an ice storage bin in the insulated compartment positioned to receive ice harvested from the ice mold; and the thermoelectric device in the thermal communication between the insulated compartment and the freezer compartment for supplying cold air to the insulated compartment.

17. A refrigerator that has a fresh food compartment, a freezer compartment, and a door that provides access to the fresh food compartment, the refrigerator comprising:

an icemaker mounted remotely from the freezer compartment, the icemaker including an ice mold;

an air pathway in communication between the icemaker and the fresh food compartment;

a thermoelectric device positioned in the fresh food compartment in communication with the air pathway, said thermoelectric device mounted remotely from the ice mold; and a fluid flow pathway in communication between the thermoelectric device and the freezer compartment.

18. The refrigerator of claim 17 further comprising a fan positioned to move air from the thermoelectric device through the air pathway to the icemaker.

19. The refrigerator of claim 18 wherein the air pathway comprises an air supply pathway in communication between:

a. an insulated compartment on the fresh food compartment door; and b. an ice mold in the insulated compartment on the fresh food compartment.

* * * * *